US006631974B2

(12) United States Patent
Shindo

(10) Patent No.: US 6,631,974 B2
(45) Date of Patent: Oct. 14, 2003

(54) INK JET RECORDING APPARATUS HAVING WIPING MECHANISM

(75) Inventor: Tatsuya Shindo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/067,860

(22) Filed: Feb. 8, 2002

(65) Prior Publication Data

US 2002/0109744 A1 Aug. 15, 2002

(30) Foreign Application Priority Data

Feb. 13, 2001 (JP) ..... 2001-035511
Feb. 13, 2001 (JP) ..... 2001-035512

(51) Int. Cl.[7] ..... B41J 2/165
(52) U.S. Cl. ..... 347/33
(58) Field of Search ..... 347/23, 24, 22, 347/29, 33, 44, 47

(56) References Cited

U.S. PATENT DOCUMENTS 5,486,850 A * 1/1996 Nakamura ..... 347/24
5,534,898 A * 7/1996 Kashino et al. ..... 347/33

FOREIGN PATENT DOCUMENTS

EP 0 913 262 A1 5/1999

* cited by examiner

*Primary Examiner*—Shih-wen Hsieh
(74) *Attorney, Agent, or Firm*—Oliff & Berridge, PLC

(57) ABSTRACT

A wiping mechanism removing foreign substances adhered to a nozzle surface without deteriorating durability of an ink-repellent coating applied on the nozzle surface. A wiper has first and second wiping members that are integrated into one piece. During normal wiping operation, the nozzle surface is wiped to remove the foreign substances therefrom, using the first wiping member, with a wiping force that is weaker than that required during a powerful wiping operation. Therefore, the normal wiping operation has little effect on the ink-repellent coating on the nozzle surface, thereby increasing the durability of the ink-repellant coating. During the powerful wiping operation, the nozzle surface is wiped, with a force stronger than that during the normal wiping operation, using the second wiping member, so that stubborn foreign substances, such as ink solidifying on the nozzle surface 24*a*, can be surely removed therefrom.

19 Claims, 13 Drawing Sheets

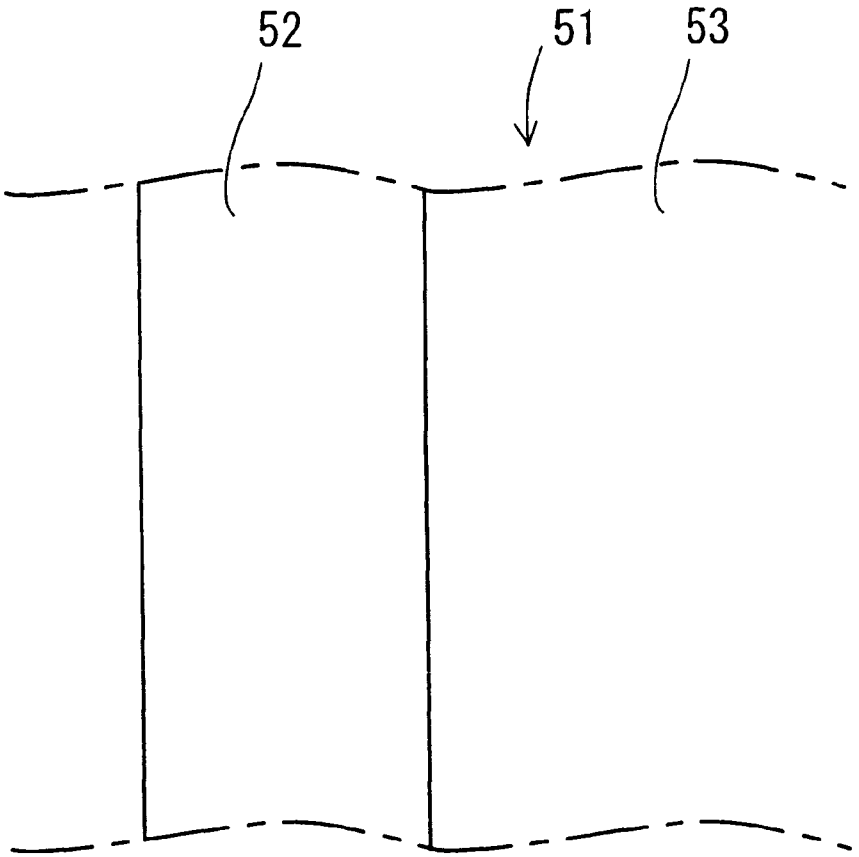
FIG.7A
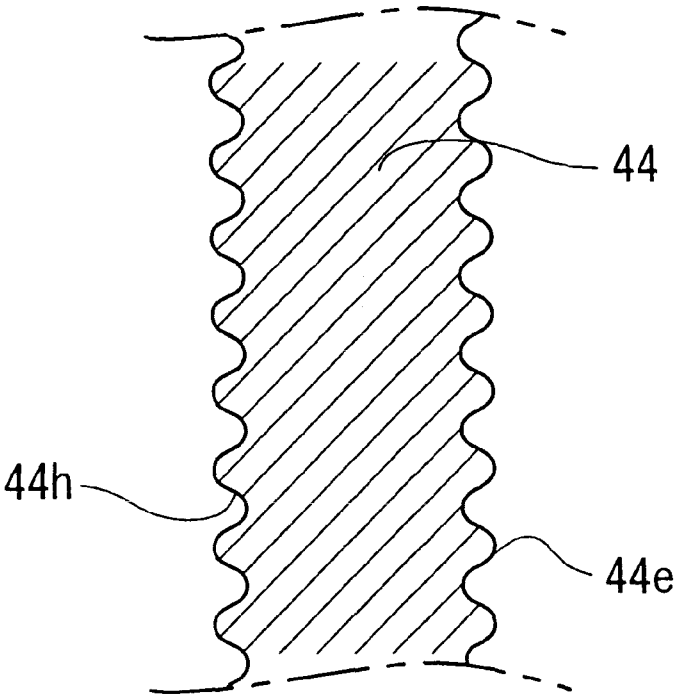

INK JET RECORDING APPARATUS HAVING WIPING MECHANISM

BACKGROUND OF THE INVENTION

1. Field of Invention

The invention relates to an ink jet recording apparatus that performs printing by ejecting an ink droplet.

2. Description of Related Art

There have been conventional recording apparatuses, such as printers, that perform printing on a recording medium, such as sheets and overhead transparency films. The recording apparatuses include a recording head for performing printing on the recording medium. For example, an ink jet head, a dot impact head, and a thermal transfer head are used as such a recording head. Among them, the ink jet head has a relatively simple structure and can perform printing at high speeds with high quality.

The ink jet head has a nozzle surface in which a plurality of nozzles that eject ink droplets are formed. If foreign substances, such as waste ink and dust, deposit in the vicinity of the nozzles, appropriate ink ejection may not be performed. For example, an ink droplet may be ejected in an improper direction from the nozzle or may not come out from the nozzle. In such cases, ink ejection recovery processing is performed on the nozzle surface to eliminate factors in preventing ejection of ink droplets.

For implementing the ink ejection recovery processing, a wiping mechanism is provided to eliminate the foreign substances adhering to the nozzle surface by wiping the nozzle surface of the ink jet head.

The nozzle surface is generally made with an ink-repellent coating. If the nozzle surface is strongly wiped by the wiping mechanism, the foreign substances on the nozzle surface can be cleanly removed. However, as a result of this, an ink-repellent coating easily comes off, thereby decreasing durability of the nozzle surface. On the other hand, if the wiping force of the wiping mechanism against the nozzle surface is weak, then the foreign substances, including solidifying ink, may not be completely removed from the nozzle surface.

SUMMARY OF THE INVENTION

The invention provides an ink jet recording apparatus having a wiping mechanism that eliminates foreign substances on a nozzle surface without decreasing durability of an ink-repellent coating on the nozzle surface.

According to one aspect of the invention, an ink jet recording apparatus includes a recording head, a wiping mechanism, a drive device and a controller. The recording head performs printing on a recording medium by ejecting ink from at least one nozzle located on a nozzle surface. The wiping mechanism has a first and a second wiping member that can contact the nozzle surface. In the wiping mechanism, at least one of the first and second wiping members wipes and cleans the nozzle surface of the recording head. The drive device moves the wiping mechanism and the recording head in relationship to each other to allow the wiping mechanism to wipe the nozzle surface. The controller selectively performs either a normal wiping operation for wiping the nozzle surface using the first wiping member with a first wiping force, or a powerful wiping operation for wiping the nozzle surface using at least the second wiping member with a second wiping force stronger than the first wiping force used during the normal wiping operation, in accordance with operational status of the ink jet recording apparatus.

According to another aspect of the invention, a wiping method is performed in an ink jet recording apparatus that includes a recording head with at least one nozzle that performs printing on a recording medium by ejecting ink from the nozzle, a wiping mechanism that wipes and cleans a nozzle surface of the recording head, in which the nozzle is formed, using first and second wiping members and a drive device that relatively moves the wiping mechanism and the recording head with respect to each other to allow the wiping mechanism to wipe the nozzle surface. In the wiping method, the operational status of the ink jet recording apparatus is analyzed. In accordance with analytical results, either a normal wiping operation in which the nozzle surface is wiped using the first wiping member with a first wiping force against the nozzle surface, or a powerful wiping operation in which the nozzle surface is wiped using at least the second wiping member with a second wiping force stronger than the first wiping force, is selectively performed.

With this structure, during the normal wiping operation, the nozzle surface is wiped using the first wiping member. Therefore, during the normal wiping operation, foreign substances on the nozzle surface is wiped and removed therefrom by a force that is weaker than the force used during the powerful wiping operation. During the powerful wiping operation, the nozzle surface is wiped using the second wiping member with a force that is stronger than that at the normal wiping operation. Accordingly, the foreign substances, including solidifying ink on the nozzle surface, can surely be eliminated from the nozzle surface.

BRIEF DESCRIPTION OF THE DRAWINGS

Embodiments of the invention will be described in detail with reference to the following figures wherein:

FIG. 7A is a sectional view of the cover plate showing asperities that have developed on a surface of the cover plate, taken along a direction perpendicular to the rolled direction indicated with an arrow C in FIG. 6;

DETAILED DESCRIPTION OF PREFERRED EMBODIMENTS

Figure 1:
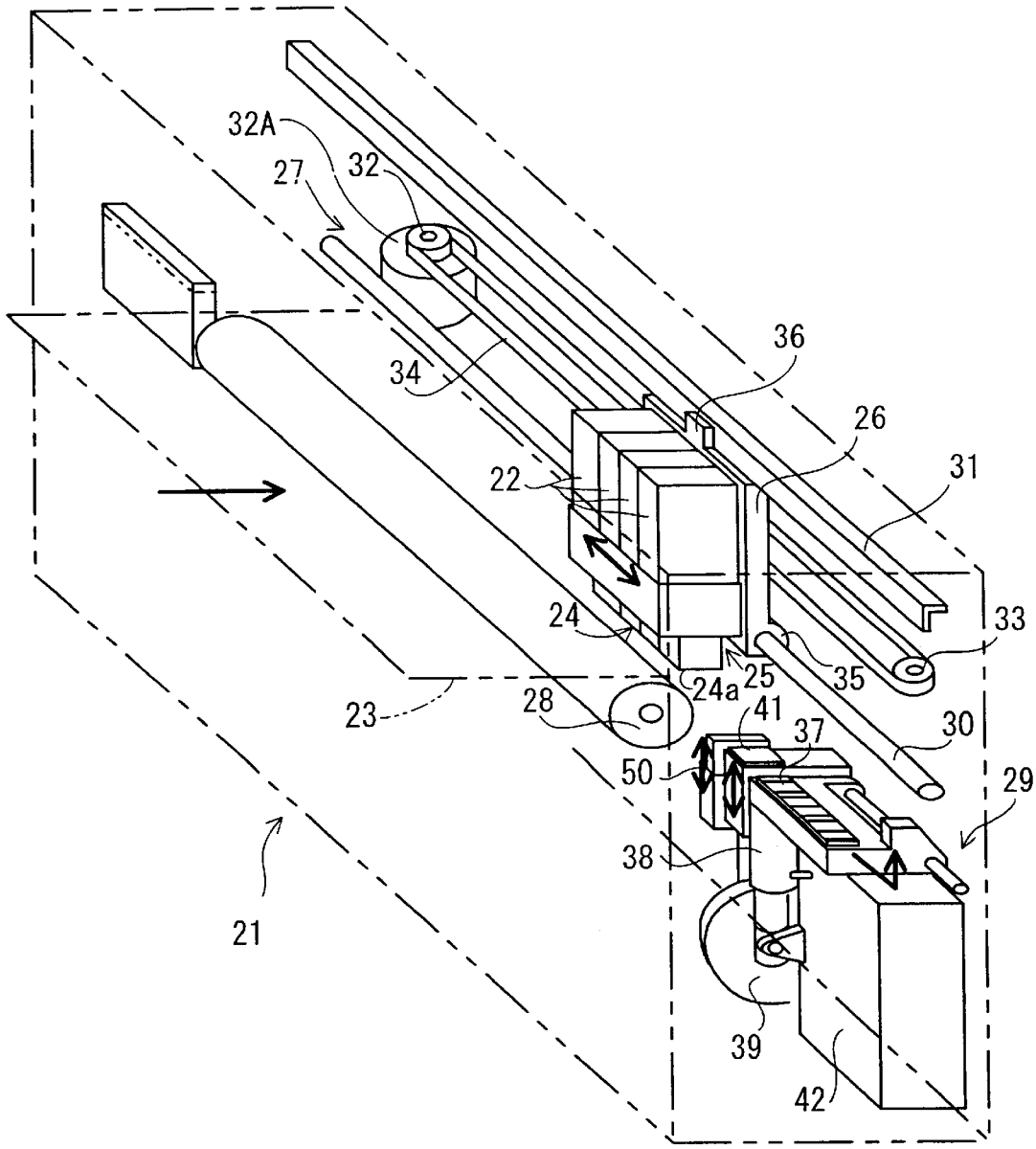
FIG. 1 is a perspective view showing an embodiment of a color ink jet printer as an ink jet recording apparatus of the invention.

Embodiments of the invention will be described with reference to the accompanying drawings. As shown in FIG. 1, a color ink jet printer 21 includes four ink cartridges 22, each of which contains a respective color of ink, such as cyan, magenta, yellow and black, a recording head unit 25 having an ink jet print head 24 for printing on a sheet 23, a carriage 26 on which the ink cartridges 22 and the recording head unit 25 are mounted, a drive unit 27 that reciprocates the carriage 26 in a straight line, a platen roller 28 that extends in a reciprocating direction of the carriage 26 and is disposed opposite to the ink jet print head 24, a wiping mechanism 50 and a purge unit 29.

The drive unit 27 includes a carriage shaft 30, a guide plate 31, two pulleys 32 and 33, and an endless belt 34. The carriage shaft 30 is disposed at a lower end portion of the carriage 26 and extends parallel to the platen roller 28. The guide plate 31 is disposed at an upper end portion of the carriage 26 and extends parallel to the carriage shaft 30. The pulleys 32 and 33 are disposed at both end portions of the carriage shaft 30 and between the carriage shaft 30 and the guide plate 31. The endless belt 34 is stretched between the pulleys 32 and 33.

A carriage shaft support portion 35, into which the carriage shaft 30 is inserted, and a guide plate contact portion 36, which can abut against the guide plate 31, are provided at the lower and upper end portions of the carriage 26, respectively. The endless belt 34 is connected with a rear surface of the carriage 26.

As the pulley 32 is rotated in normal and reverse directions by a carriage motor 32A, the carriage 26 connected to the endless belt 34 is reciprocated in the straight direction along the width direction of the sheet 23, on the carriage shaft 30 and the guide plate 31, in accordance with the normal and reverse rotation of the pulley 23.

The sheet 23 is supplied from a sheet cassette (not shown) provided in the ink jet printer 21 and is fed into between the platen roller 28 and a nozzle surface 24*a* of the recording head unit 25 which is facing downward in a vertical direction. Then, predetermined printing is performed therebetween by ink droplets ejected from a plurality of nozzles formed in the ink jet head 24. After that, the sheet 23 is discharged to the outside. A sheet feeding mechanism and a sheet discharging mechanism are omitted from FIG. 1.

The wiping mechanism 50 is disposed on the side of the platen roller 28 to remove foreign substances, such as waste ink and dust, adhering to the nozzle surface 24*a*, by wiping the nozzle surface 24*a* of the recording head unit 25. The purge unit 29 is disposed next to the wiping mechanism 50 so as to be opposed to the nozzle surface 24*a* when the recording head unit 25 is located in a reset position. The purge unit 29 is provided to prevent a defect in ink ejection caused by a buildup of ink and development of air bubbles in the ink jet print head 24 when ink is first installed into the ink jet print head 24.

The purge unit 29 includes a suction cap 41, a suction pump 38, a cam 39, and a waste ink reservoir 42. The suction cap 41 contacts the nozzle surface 24*a* to cover a plurality of nozzles (described later) formed in the ink jet print head 24. When the recording head unit 25 is placed in the reset position, the nozzle surface 24*a* is covered with the suction cap 41 to inhale ink including air bubbles trapped in the ink jet print head 24 by the suction pump 38 and by the cam 39, thereby purging the ink jet print head 24. Thus, an ink ejection recovery processing for preventing defective ink ejection, caused by a buildup of ink and development of air bubbles in the ink jet print head 24 when ink is first installed into the ink jet print head 24, can be implemented. Inhaled ink is stored in the waste ink reservoir 42.

In the purge unit 29, a protective cap 37, which is located next to suction cap 41, is provided for each color of ink to cover the nozzles. When the recording head unit 25 is located in a stop position, the protective caps 37 contact the nozzle surface 24*a* to cover the nozzles for all color of ink.

Figure 4:
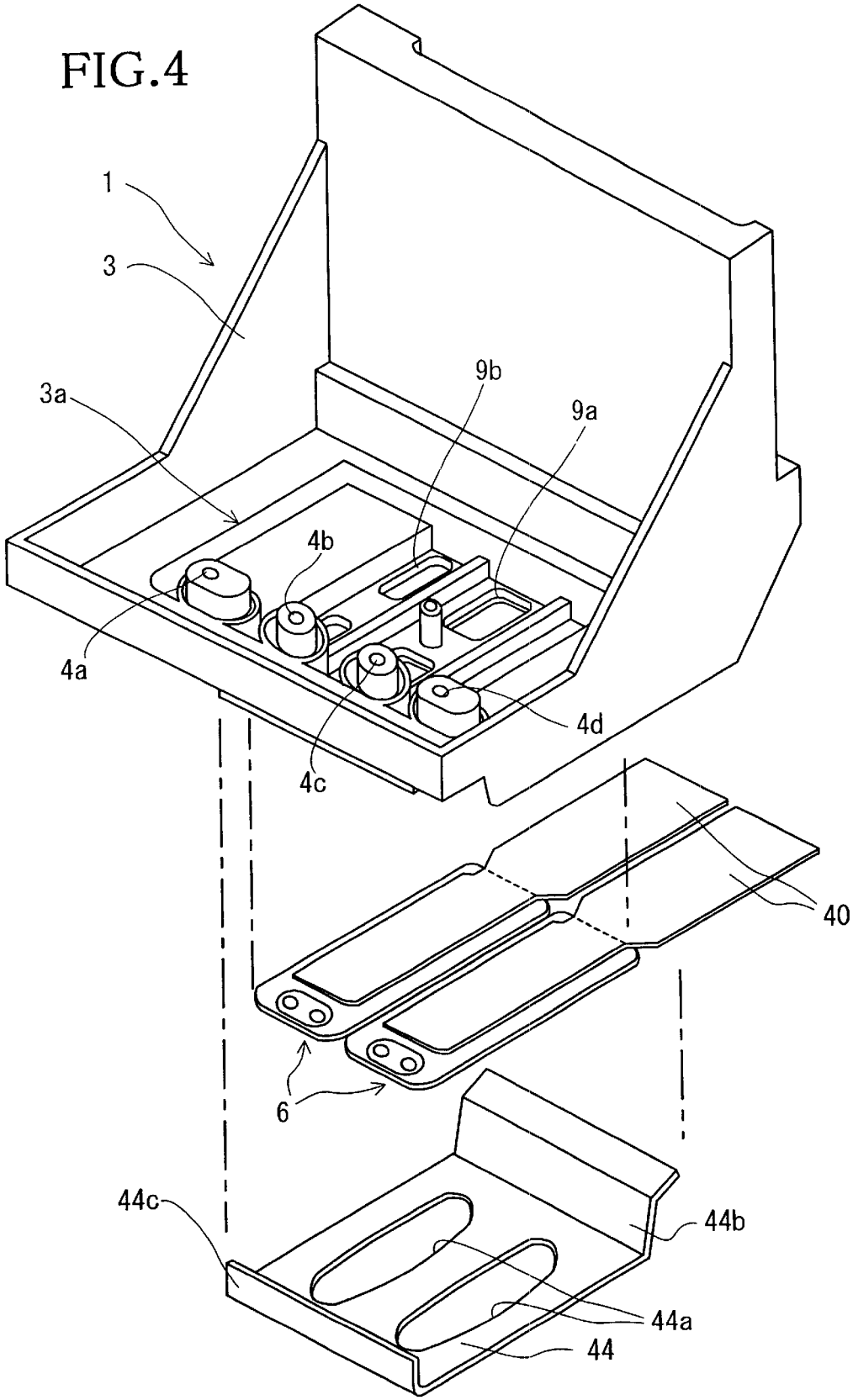
FIG. 4 is a disassembled perspective view showing the parts of the recording head unit, with a main frame facing upward.

A main frame 1 of the recording head unit 25, which is to be mounted on the carriage 26 that moves along the sheet 23, is an injection molded frame made of synthetic resin material, such as polyproethylene and polypropylene, and has a substantially box shape with an upper open structure. As shown in FIG. 4, the main frame 1 has a mounting portion 3 on which the four ink cartridges 22 are detachably attached from above. Ink supply paths 4*a*, 4*b*, 4*c*, 4*d*, each of which connects to respective ink outlets (not shown) of each ink cartridge 22, are provided at one side 3*a* of the mounting portion 3 and communicate with the bottom of a bottom plate 5 of the main frame 1. An upper surface of each of the ink supply paths 4*a*, 4*b*, 4*c*, 4*d* is provided with a rubber packing (not shown) to intimately contact the ink outlet.

Figure 3:
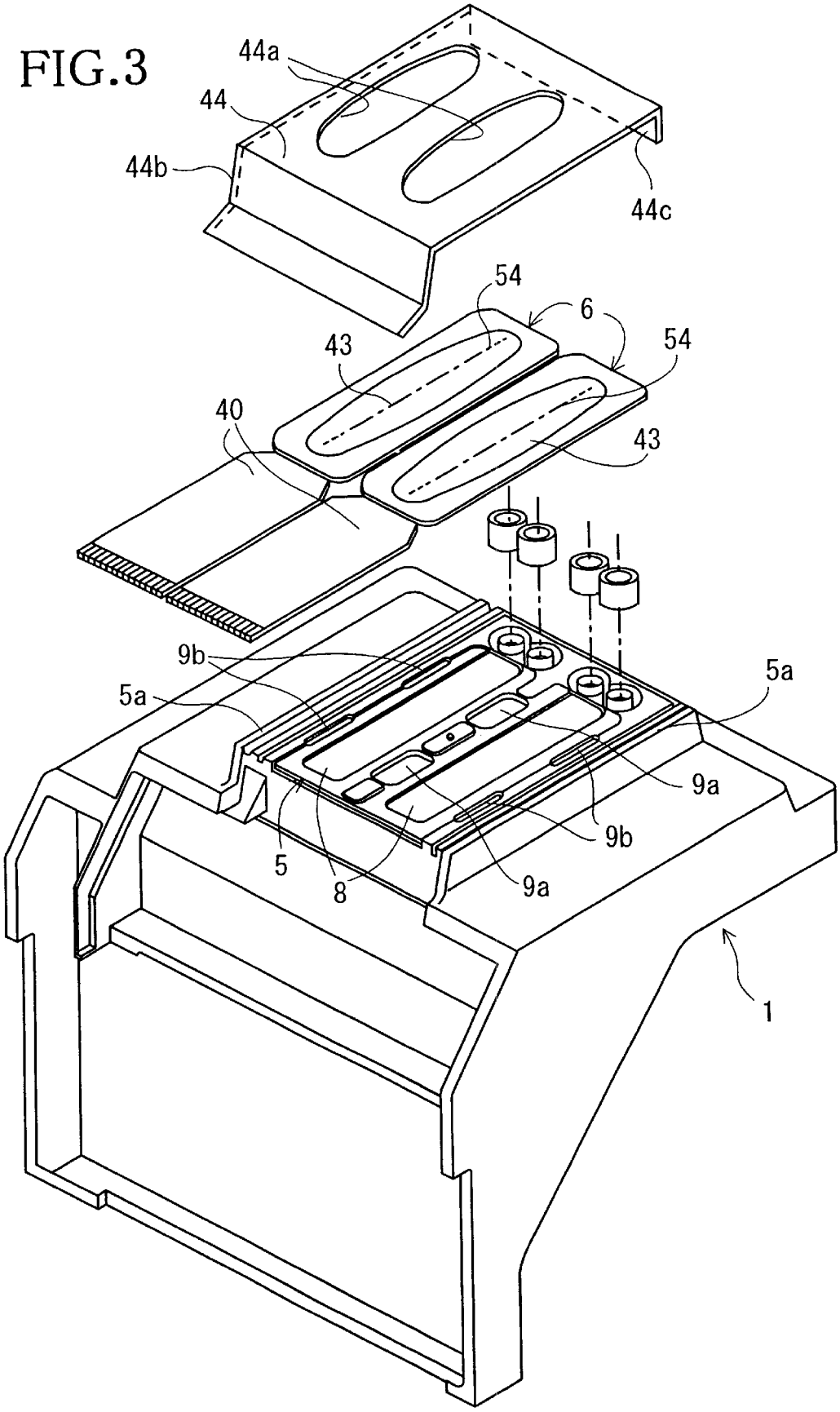
FIG. 3 is a perspective view of parts of the recording head unit.

As shown in FIGS. 3 and 4, the bottom plate 5 is stepped down to protrude from the mounting portion 3 and extends in a horizontal direction. On the underside of the bottom plate 5, two stepped supports 8 are formed to receive front head units 6 which are parallel to each other. In the bottom plate 5, a plurality of recesses 9*a*, 9*b*, which are filled with an UV adhesive to bond the respective blocks of the front head units 6, are formed so as to penetrate the bottom plate 5.

Each of the front head units 6 includes a cavity plate (not shown) having a nozzle plate 43 in which a plurality of nozzles 54 are formed, a plate-type piezoelectric actuator (not shown) that is bonded to the cavity plate using an adhesive or an adhesive sheet, and a flexible flat cable 40 that is bonded using an adhesive to the upper surface of the piezoelectric actuator for electric connection with external equipment. The nozzles 54 are formed on the underside of the cavity plate at the bottom and ink is ejected downward therefrom. Ink-repellent coating is applied to the nozzle plate 43 using fluorine. A contact angle of the nozzle plate 43 with respect to ink is between 80 and 90 degrees. Each front head unit 6 has the nozzles 54, the piezoelectric actuator and the like to eject two colors of ink.

As shown in FIG. 3, the recesses 9*a*, 9*b* are formed at positions near four corners of one front head unit 6 to be fixed. In the embodiment, the recesses 9*a* are provided at positions where one of sides of the support 8 is adjacent to one of sides of the other support 8 (longitudinal sides in the embodiment). The recesses 9*a* are wide so as to extend to the back of both front head units 6.

Figure 2:
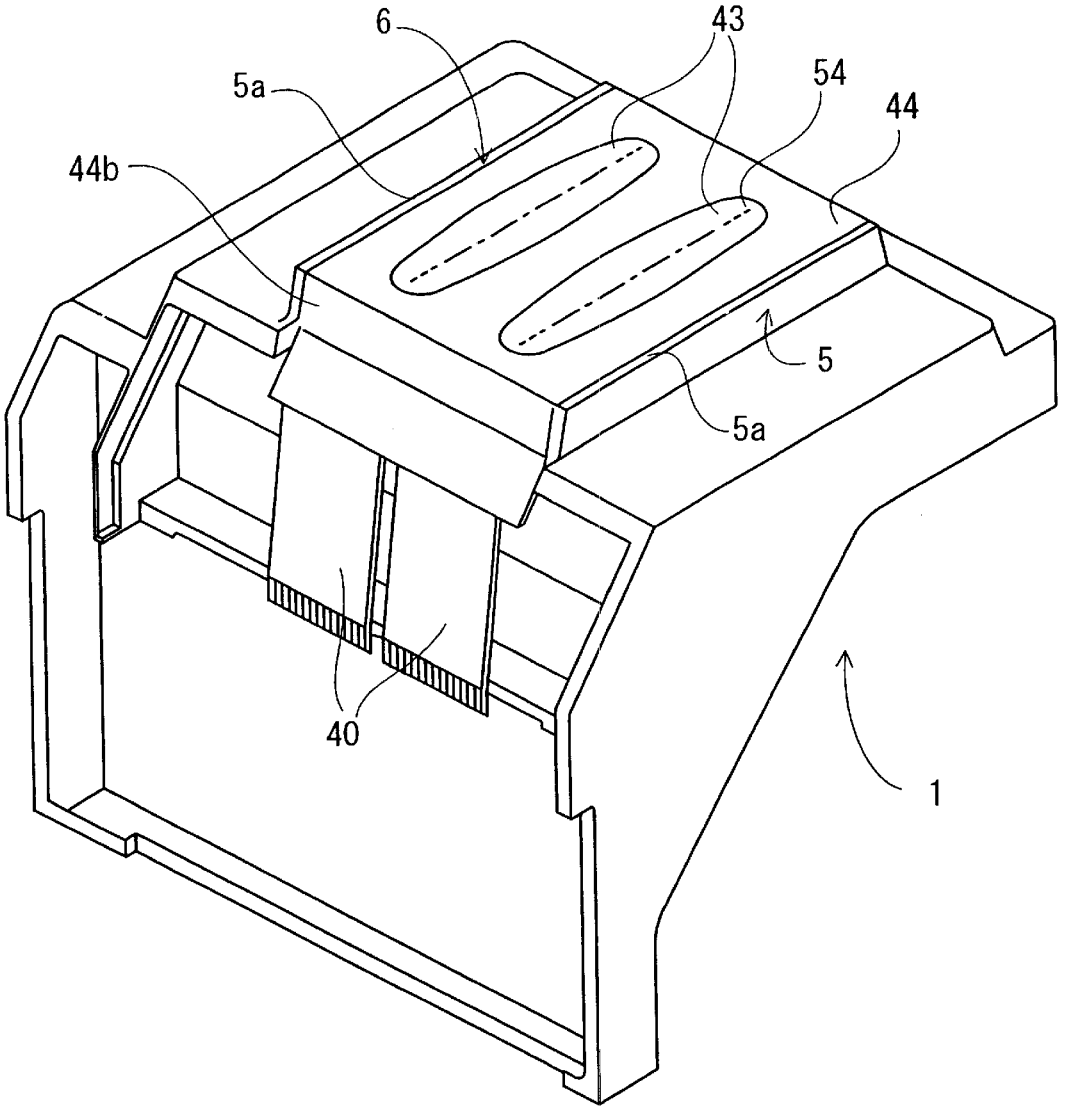
FIG. 2 is a perspective view of a recording head unit, with its nozzles facing upward.
Figure 6:
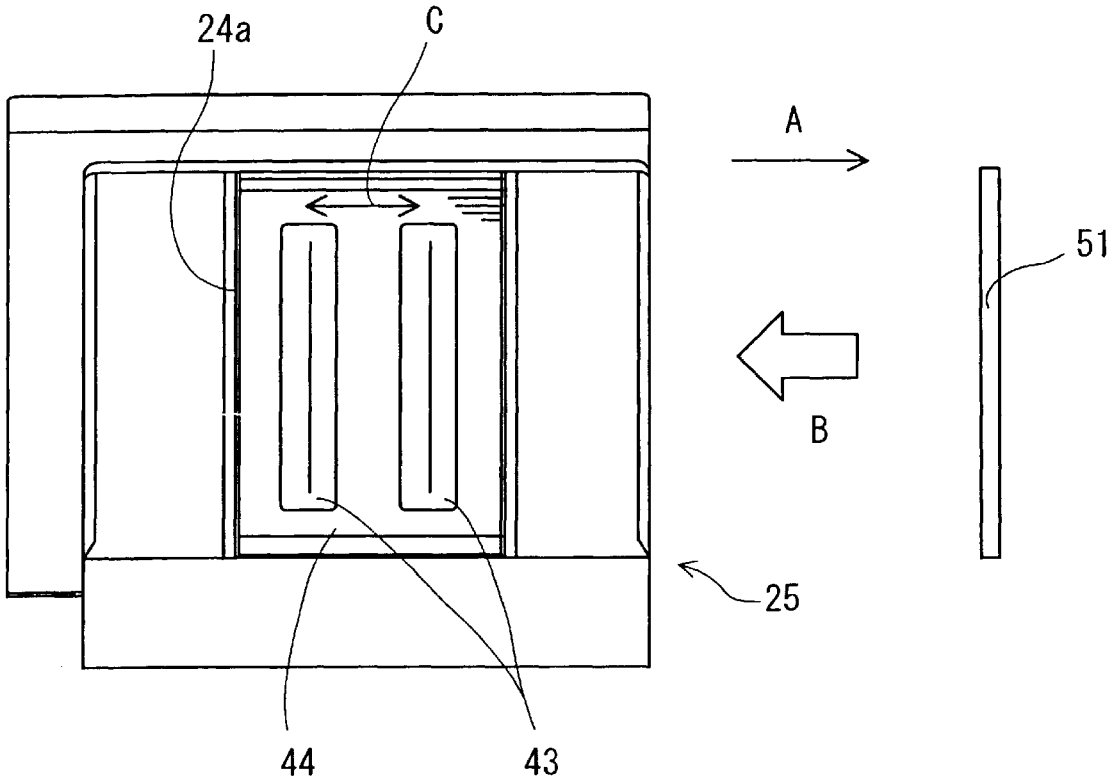
FIG. 6 is an explanatory diagram of a bottom view showing a rolled direction of a cover plate and a wiping direction of the wiper.
Figure 7B:
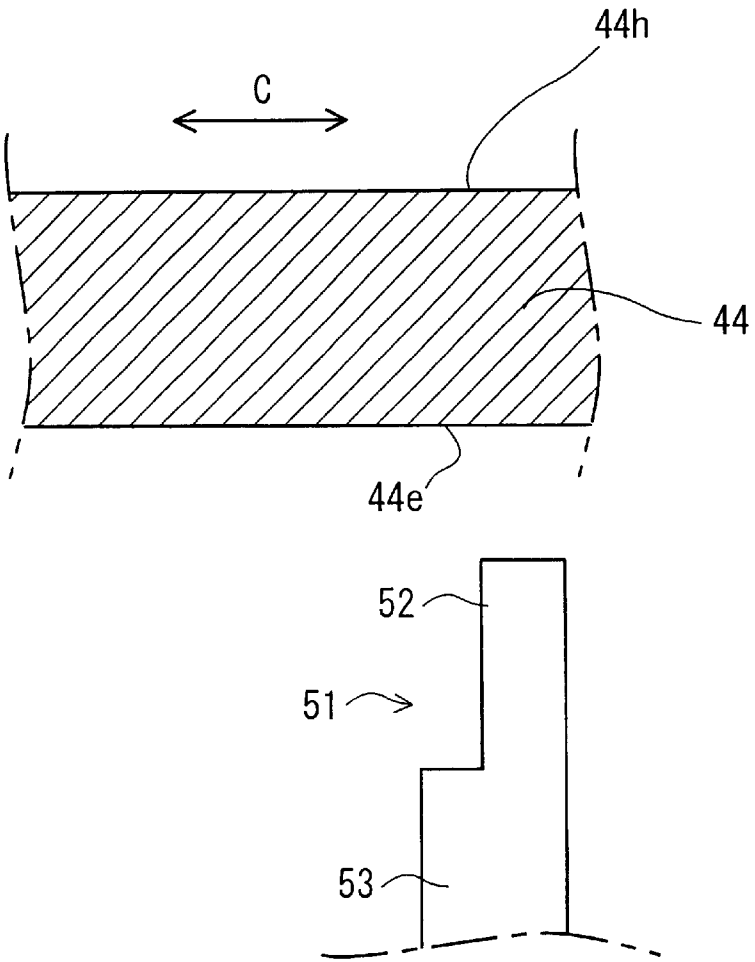
FIG. 7B is a sectional view of the cover plate showing asperities that have developed on the surface of the cover plate, taken along a direction parallel to the rolled direction indicated with the arrow C in FIG. 6.

As shown in FIG. 2, a cover plate 44 made from a thin elastic metal plate (e.g. stainless) is fixed to the bottom surface of the front head units 6. The cover plate 44 is formed by rolling metal into a plate so that, in the cover plate 44, microscopic asperities develop on top and bottom surfaces 44*e*, 44*h* respectively, as shown in FIGS. 7A and 7B. The asperities extend along a rolled direction. The asperities developed along a direction perpendicular to the rolled direction are more congested than the asperities developed along a direction parallel to the rolled direction. The asperities developed along a direction parallel to the rolled direction are extended such that the asperities seem almost flat. As shown in FIG. 6, the cover plate 44 is adhered to the nozzle surface 24*a* so that the rolled direction of the cover plate 44 (a direction indicated with an arrow C in FIG. 6) is substantially parallel with a direction of wiping the nozzle surface 24*a* by a wiper 51 (a direction indicated with an arrow B in FIG. 6). That is, an extending direction of the asperities developing on the top surface 44*e* of the cover plate 44 by rolling is in parallel with the wiping direction of the wiper 51 and wiped using the wiper 51. A contact angle between the top surface 44*e* of the cover plate 44 and ink is about 30 degrees.

As shown in FIGS. 2 to 4, the cover plate 44 has holes 44*a* corresponding with the nozzle plates 43, in a middle portion. Both ends of the cover plate 44 are bent along the sides of the main frame 1 to form bent portions 44*b*, 44*c*. The bent portion 44*b* covers a middle portion of the flexible flat cables 40.

The cover plate 44 is fixed with respect to the main frame 1 with a periphery of the cover plate 44 sealed using a sealant, such as a silicon adhesive. That is, spaces between side edges of the cover plate 44 and ribs 5*a* protruding from both sides of the bottom plate 5 and a space between the bent portion 44*c* and the side of the main frame 1 are filled with the sealant. Spaces between the bent portion 44*b* and the flexible cable 40 and between the cable 40 and the main frame 1 are also filled with the sealant.

Spaces between internal circumferences of the holes 44*a* in the cover plate 44 and the surface of the front head units 6 are sealed using an adhesive. Thus, a space between the front head units 6 is covered with the cover plate 44 and a space between the main frame 1 and the periphery of the front head units 6 is covered with the cover plate 44 and is sealed using the sealant. Accordingly, ink, dust and the like is prevented from entering between the main frame 1 and the front head units 6, so that an occurrence of a short-circuit can be prevented at an electrically connected portion of the piezoelectric actuator and the flexible flat cable 40. The bent portion 44*b* guides a drawing direction of the flexible flat cables 40 and protects the cables 40. As described above, the nozzle plates 43 and cover plate 44 are provided on the nozzle surface 24*a* of the recording head unit 25.

Figure 8:
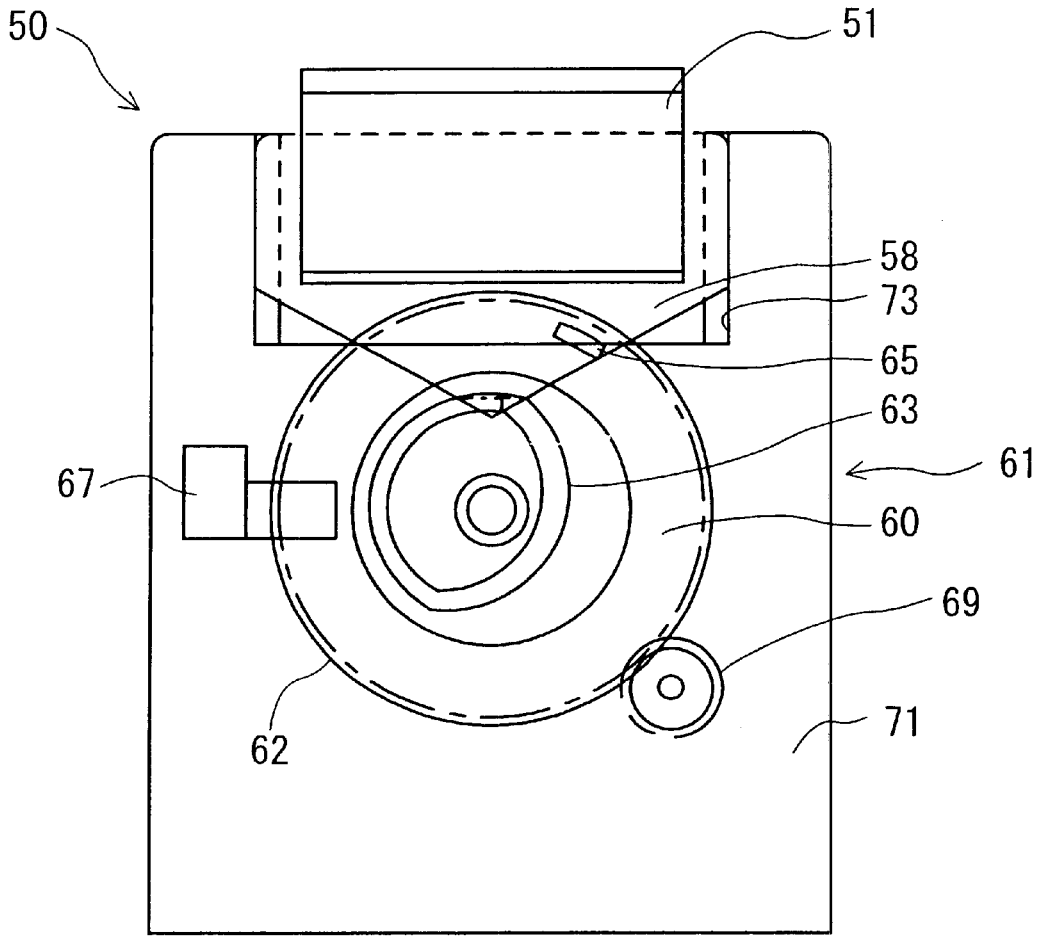
FIG. 8 is a diagram showing a wiping mechanism.

As shown in FIG. 8, the wiping mechanism 50 includes the wiper 51 that wipes the nozzle surface 24*a*, the wiper holder 58 that supports the wiper 51, and a moving mechanism 61 that can move the wiper holder 58 in approaching and receding directions with respect to the nozzle surface 24*a*.

Figure 9A:
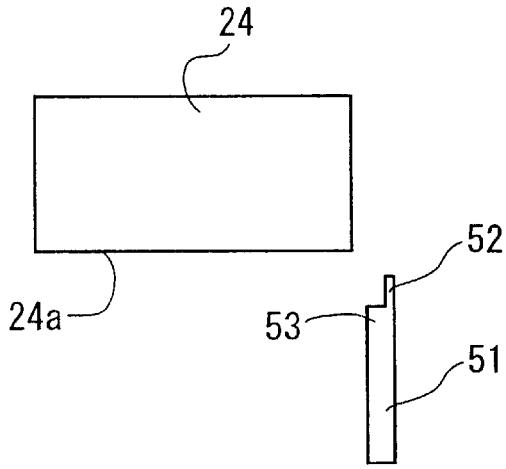
FIG. 9A is a diagram showing a state where the wiper is placed in a position distant from the nozzle surface during a normal wiping operation.
Figure 9B:
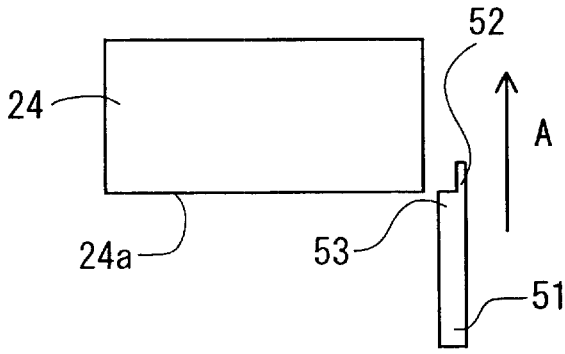
FIG. 9B is a diagram showing a state where the wiper is approaching the nozzle surface during the normal wiping operation.
Figure 9C:
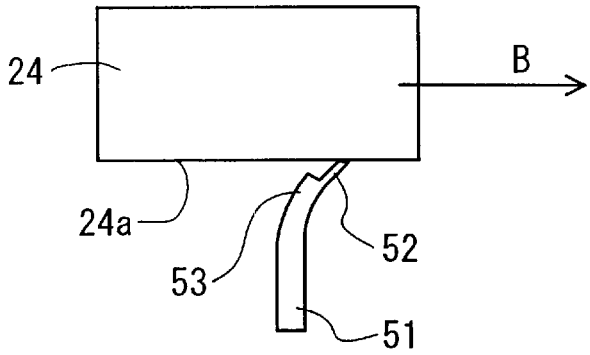
FIG. 9C is a diagram showing a state where a first wiping member is wiping the nozzle surface during the normal wiping operation.

The wiper 51 is molded of rubber material, for example, ethylene propylene diene monomer (EPDM). As shown in FIGS. 9A to 9C, for example, a first wiping member 52 is integrally formed with a second wiping member 53. The first wiping member 52 extends from a tip of the second wiping member 53. The second wiping member 53 is thicker than the first wiping member 52 in the direction of the wiping of the nozzle surface 24*a* by the wiper 51. Therefore, a wiping force of the second wiping member 53 against the nozzle surface 24*a* is stronger than that of the first wiping member 52.

As shown in FIG. 8, one end portion of the wiper 51 is supported by the wiper holder 58. The wiper holder 58 is engaged with a guide groove 73 formed in a housing 71 of the moving mechanism 61. The wiper holder 58 can move along the guide groove 73, in approaching and receding directions with respect to the nozzle surface 24*a*. A projection (not shown) provided to the wiper holder 58 is engaged with a cam groove 63 in a cam plate 60 rotatably supported by the housing 71. The cam plate 60 has a slit 65. A home position detecting sensor 67, that detects a home position of the cam plate 60 by detecting the slit 65, is attached to the housing 71. The housing 71 is provided with the wiper motor (not shown). A gear portion 62 of the cam plate 60 is engaged with a motor gear 69 fixed to a shaft of the wiper motor.

A CPU (not shown) controls the color ink jet printer 21, such as the carriage motor 32A, a suction motor, and a wiper motor, based on a program stored in a ROM (not shown).

The CPU and the program in the RAM control the carriage motor 32A, the suction motor and the wiper motor to implement the ink ejection recovery processing using the wiping mechanism 50 structured as described above.

Figure 5:
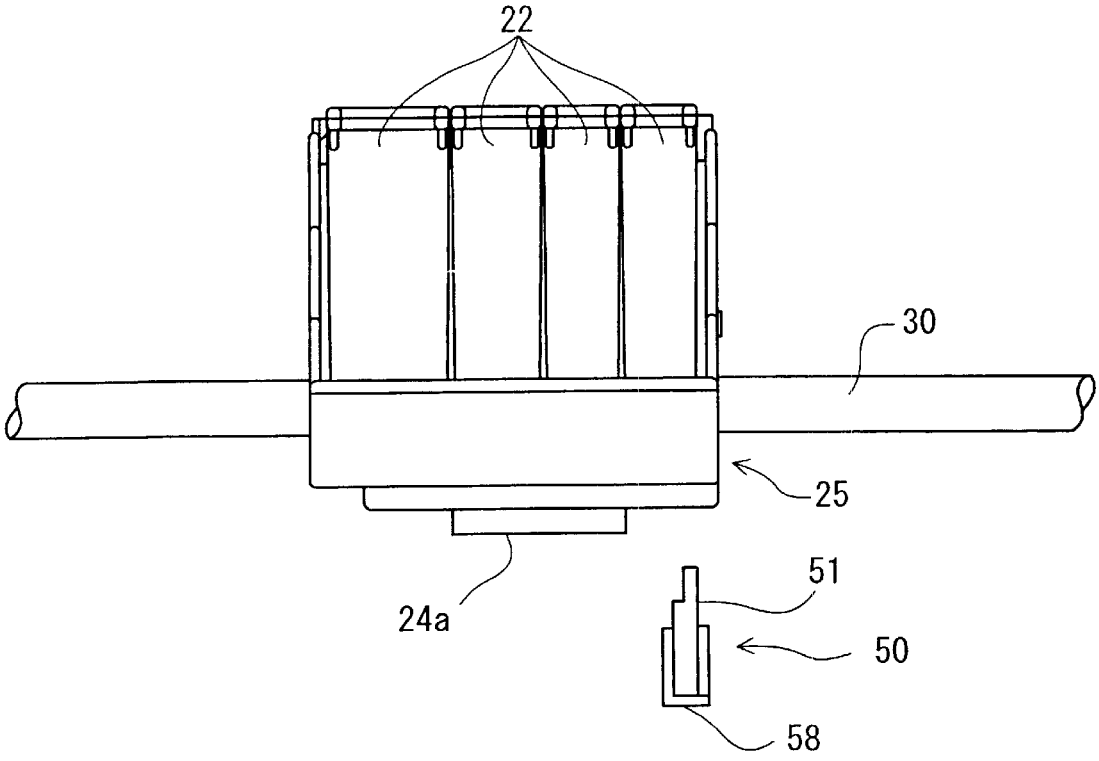
FIG. 5 is an explanatory diagram showing a state where a wiper is approaching a nozzle surface during a wiping operation.

When the power of the color ink jet printer 21 is turned on and immediately before printing operation is performed, the ink ejection recovery processing is performed. In the processing, a wiping operation is performed to remove the foreign matters on the nozzle surface 24*a* by the wiper 51 wiping the nozzle surface 24*a*. At the wiping operation, first, as shown in FIG. 5, the recording head unit 25 is located in a predetermined position where it is not opposed to the wiper 51. Then, as the wiper motor is driven, a wiper holder 58 moves in a direction approaching the nozzle surface 24*a* and stops at a position where the wiper 51 can contact the nozzle surface 24*a*.

In this state, the carriage motor 32A is driven to move the recording head unit 25 in a direction of approaching the wiper 51 (a direction indicated with an arrow A in FIG. 6). As a result, the wiper 51 relatively wipes the nozzle surface in the direction of the arrow B to remove the substances adhered to the nozzle surface 24*a*. After that, the wiper 51 is moved to a position distant from the nozzle surface 24*a*.

A normal wiping operation is implemented when the ink ejection recovery processing is to be performed at regular time intervals or when it is performed before a certain time has elapsed since a preceding printing operation was completed or a preceding ink ejection recovery processing was performed. During the normal wiping operation, first, the ink jet print head 24 is located at a predetermined position where it is not opposed to the wiper 51, as shown in FIG. 9A.

Then, as the motor gear 69 and the cam plate 60 rotates by the wiper motor, the wiper holder 58 having the projection engaged with the cam groove 63 moves in a direction of approaching the nozzle surface 24*a* (a direction indicated with an arrow A in FIG. 9B), along the guide groove 73. That is, the wiper 51 is moved to a position where the first wiping member 52 can contact the nozzle surface 24*a*, but the second wiping member 53 cannot contact the nozzle surface 24*a*, and is brought to a standstill at that position.

From this state, the ink jet print head 24 is moved in a direction approaching the wiper 51 (a direction indicated with an arrow B in FIG. 9C) by the carriage motor 32A. Thus, the first wiping member 52 wipes the nozzle surface 24*a* to remove the foreign substances adhered to the nozzle surface 24*a*. Then, the wiper 51 is moved to a position where it is apart from the nozzle surface 24*a* so that the wiper 51 cannot contact the nozzle surface 24*a* (a position indicated in FIG. 9A).

Figure 10A:
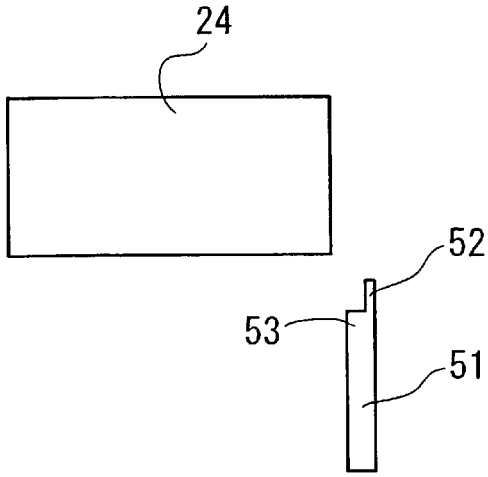
FIG. 10A is a diagram showing a state where the wiper is placed in a position distant from the nozzle surface during a powerful wiping operation.
Figure 10B:
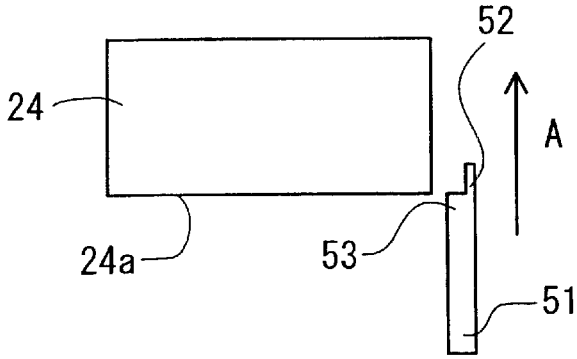
FIG. 10B is a diagram showing a state where the wiper is approaching the nozzle surface during the powerful wiping operation.

On the other hand, a powerful wiping operation is implemented when the ink ejection recovery processing is to be performed after a longer time has passed since a last printing was performed or the last processing was performed. During the powerful wiping operation, as shown in FIG. 10A, first, the ink jet head 24 is located at a predetermined position where it is not opposed to the wiper 51, as shown in FIG. 10A. Then, by the wiper motor, the wiper holder 58 moves in a direction approaching the nozzle surface 24*a* (a direction indicated with an arrow A in FIG. 10B), along the guide groove 73. That is, the wiper 51 is moved to a position where the first and second wiping members 52, 53 can contact the nozzle surface 24*a*, and is brought a standstill at that position.

Figure 10C:
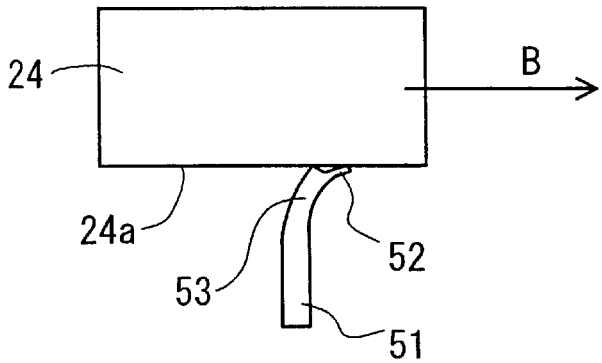
FIG. 10C is a diagram showing a state where the first and second wiping members are wiping the nozzle surface during the powerful wiping operation.

From this state, the ink jet print head 24 is moved in a direction approaching the wiper 51 (a direction indicated with an arrow B in FIG. 10C) by the carriage motor 32A. Thus, the first and second wiping members 52, 53 wipe the nozzle surface 24*a* to remove the foreign substances adhered to the nozzle surface 24*a*. Then, the wiper 51 is moved to a position where it is apart from the nozzle surface 24*a* so that the wiper 51 cannot contact the nozzle surface 24*a* (a position indicated in FIG. 10A).

As described above, during the normal wiping operation, the nozzle surface 24*a* is wiped to remove the foreign substances therefrom, using only the first wiping member 52, with a wiping force that is weaker than that required during the powerful wiping operation. Therefore, the normal wiping operation has little effect on the ink-repellent coating on the nozzle surface 24*a*, thereby increasing durability of the coating. During the powerful wiping operation, the nozzle surface 24*a* is wiped, with a wiping force that is stronger than that required during the normal wiping operation, using the second wiping member 53, so that stubborn foreign substances, such as ink being solidifying on the nozzle surface 24*a*, can be surely removed. Accordingly, the wiping force of the wiper 51 during the powerful wiping operation is different from that during the normal wiping operation. By providing the use of both types of operations, the ink-repellent coating on the nozzle surface 24*a* is less effected by the wiping, as compared to a case where the nozzle surface 24*a* is always wiped with a strong force. Further, the stubborn foreign substances can be removed from the nozzle surface 24*a*.

The length of the first and second wiping members 52, 53 toward the nozzle surface 24*a* (the protrusion amount with respect to the nozzle surface 24*a* in a direction perpendicular to the wiping direction) is different from each other. Therefore, the normal and powerful wiping operation can be performed by only controlling a location of the wiper 51 with respect to the nozzle surface 24*a*. During the normal wiping operation, only the first wiping member 52 wipes the nozzle surface 24*a*, and during the powerful wiping operation, both the first and second wiping members 52, 53 wipe the nozzle surface 24*a*. With this simple structure, the wiping force against the nozzle surface 24*a* can be changed between the normal and powerful wiping operation.

The first wiping member 52 is integral with the second wiping member 53, so that the wiper 51 can be easily produced.

Figure 11:
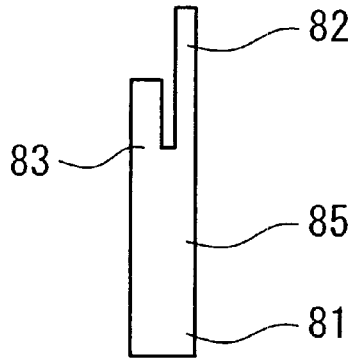
FIG. 11 is a diagram showing a wiper of another embodiment.

The first wiping member 52 protrudes from the tip of the second wiping member 53 and is integral with the second wiping member 53 without a clearance therebetween in the wiping direction of the nozzle surface 24*a* by the wiper 51. Accordingly, the wiper 51 can be thinner than a wiper 81 (described later), in which a clearance is provided therebetween as shown in FIG. 11.

As described above, the cover plate 44 is made of a metal, which is rolled into a plate, is adhered to the nozzle surface 24*a* so that the rolled direction of the cover plate 44 (the direction of the arrow C in FIG. 6) is substantially parallel with the direction of the wiping of the nozzle surface 24 by the wiper 51 (the direction of the arrow B in FIG. 6). Therefore, the extending direction of the microscopic asperities, which have developed on the surface 44 of the cover plate 44 by rolling, is substantially parallel with the direction of the wiping of the nozzle surface 24 by the wiper 51. Accordingly, when the nozzle surface 24*a* is wiped using the wiper 51, the foreign substances are hardly left in the asperities, so that the substances can be surely removed from the nozzle surface 24*a*.

Figure 13:
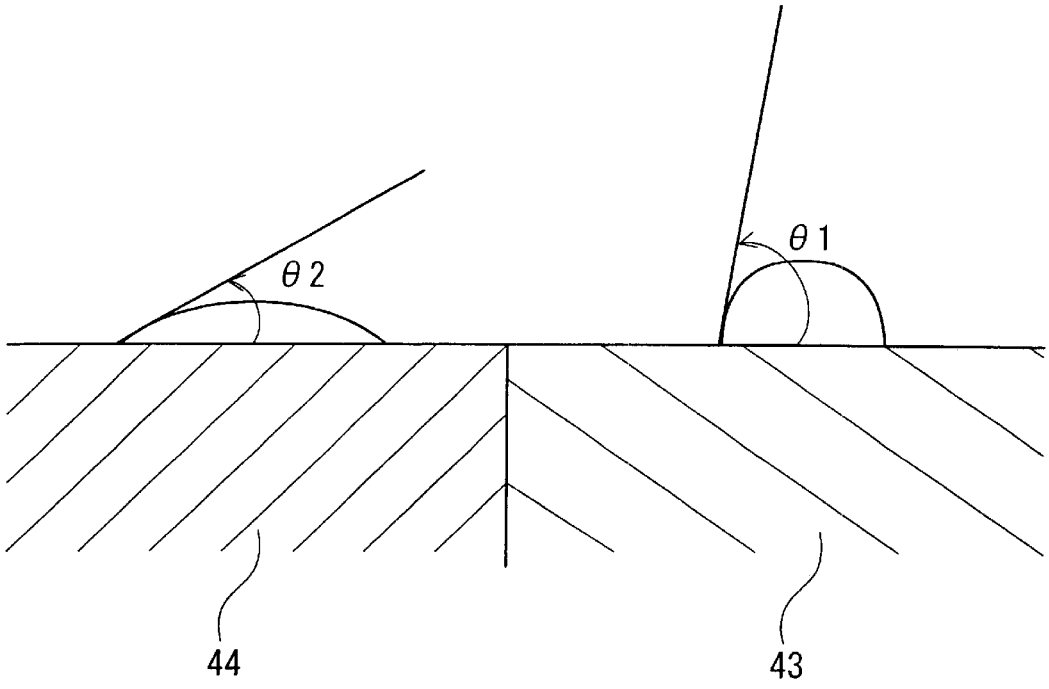
FIG. 13 is an explanatory diagram showing a contact angel "θ1" of the nozzle plate 43 with respect to the ink and a contact angle "θ2" of the cover plate 44 with respect to the ink. It is preferable that the contact angle θ1 is above 40 degrees larger than the contact angle θ2. The contact angle θ1 is between 80–90 degrees and the contact angle θ2 is about 30 degrees in the embodiments of this application.

It has been proven that it is difficult for ink to remain on the nozzle plate 43 when the nozzle surface 24*a* is wiped using the wiper 51 when the contact angle θ1 of the nozzle plate 43 with respect to ink is larger than the contact angle θ2 of the cover plate 44 with respect to the ink as shown in FIG. 13. Thus, with this structure, the foreign substances can be easily removed from the nozzle plate 43.

Further, it is preferable that the contact angle θ1 of the nozzle plate 43 with respect to the ink is above 40 degrees larger than the contact angle θ2 of the cover plate 44 with respect to the ink, so that the ink hardly remains on the nozzle plate 43 when the nozzle surface 24*a* is wiped using the wiper 51. In the embodiments of this application, the contact angle θ1 is between 80–90 degrees and the contact angle θ2 is about 30 degrees. Consequently, with this structure, the foreign substances can be surely removed from the nozzle surface 24*a*.

A cover plate may be formed so as to cover the ribs 5*a* protruding from the main frame 1, that is, to cover the nozzle surface 24*a* and side surfaces (the ribs 5*a*) to be wiped by the wiper 51. With this structure, corners formed by the nozzle surface 24*a* and the side surfaces (the ribs 5*a*) are covered with the cover plate. Therefore, when the nozzle surface 24*a* is wiped by the wiper 51, it is difficult for foreign substances to remain on the corners.

In the color ink jet printer 21 provided with the recording head unit 25 having the cover plate 44 as described above, it is difficult for foreign substances to remain in the asperities on the top surface 44*e* of the cover plate 44. Thus, ink droplets are favorably ejected from the nozzles 54 in the ink jet print head 24, so that printing can be satisfactorily performed on the sheet 23.

Next, another embodiment of the invention will be described. Similar parts to those in the aforementioned embodiment are identified by similar reference numerals and explanation for them will be omitted.

As shown in FIG. 11, the wiper 81 is molded of rubber material, for example, ethylene propylene diene monomer (EPDM). A first wiping member 82 is integrally formed with a second wiping member 83. The first and second wiping members 82, 83 extend from a tip of a base 85. The first wiping member 82 is longer than the second wiping member 83, in the direction towards the nozzle surface 24*a*. A clearance is provided between the first and second wiping members 52, 53 in the direction of the wiping of the nozzle surface 24*a* by the wiper 81. The second wiping member 83 is thicker than the first wiping member 82 in the direction of the wiping of the nozzle surface 24*a* by the wiper 81. Therefore, a wiping force of the second wiping member 83 against the nozzle surface 24*a* is stronger than that of the first wiping member 82. One end of the base 85 is supported by the wiper holder 58.

The wiper 81 structured as described in FIG. 11 has advantages similar to those offered by the wiper 51.

Next, another embodiment of the invention will be described. Similar parts to those in the aforementioned embodiments are identified by similar reference numerals and explanation for them will be omitted.

Figure 12:
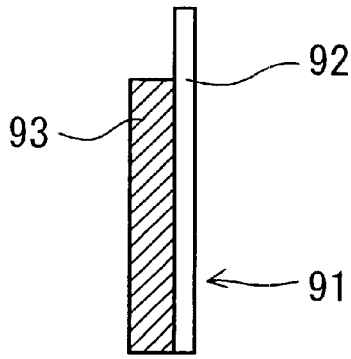
FIG. 12 is a diagram showing a wiper of yet another embodiment.

As shown in FIG. 12, a wiper 91 is molded of rubber material. A first wiping member 92 and a second wiping member 93 are separate parts. The first wiping member 92 is longer than the second wiping member 93, in the direction towards the nozzle surface 24*a*. The first and second wiping members 92, 93 intimately contact each other. The second wiping member 93 is thicker than the first wiping member 92 in the direction of the wiping of the nozzle surface 24*a* by the wiper 91. Therefore, a wiping force of the second wiping member 93 against the nozzle surface 24*a* is stronger than that of the first wiping member 92. End portions of the first and second wiping members 92, 93 that do not face toward the nozzle surface 24*a* are supported by the wiper holder 58.

The wiper 91 structured as shown in FIG. 12 has advantages similar to those offered by the wiper 51.

As described above, during the normal wiping operation, the nozzle surface 24*a* is wiped to remove the foreign substances therefrom, using only the first wiping member 92, with a wiping force that is weaker than that required during the powerful wiping operation. Therefore, the normal wiping operation has little effect on the ink-repellent coating on the nozzle surface 24*a*, thereby increasing durability of the coating. During the powerful wiping operation, the nozzle surface 24*a* is wiped, with a wiping force that is stronger than that required during the normal wiping operation, using the second wiping member 93, so that stubborn foreign substances, such as ink solidifying on the nozzle surface 24*a*, can be surely removed. Accordingly, the wiping force of the wiper 91 during the powerful wiping operation is different from that during the normal wiping operation. By providing the use of both types of operations, the ink-repellent coating on the nozzle surface 24*a* is less effected by the wiping, as compared to a case where the nozzle surface 24*a* is always wiped with a strong force. Further, the stubborn foreign substances can be removed from the nozzle surface 24*a*.

The length of the first and second wiping members 92, 93 toward the nozzle surface 24*a* (the protrusion amount with respect to the nozzle surface 24*a* in a direction perpendicular to the wiping direction) is different from each other. Therefore, the normal and powerful wiping operation can be performed by only controlling a location of the wiper 91 with respect to the nozzle surface 24*a*. During the normal wiping operation, only the first wiping member 92 wipes the nozzle surface 24*a*, and during the powerful wiping operation, both the first and second wiping members 92, 93 wipe the nozzle surface 24*a*. With this simple structure, the wiping force against the nozzle surface 24*a* can be changed between the normal and powerful wiping operation.

In this embodiment, the first and second wiper members 92, 93 are separately formed, so that the first and second wiping members 92, 93 can be made of different materials. Accordingly, the wiping force can be changed by the thickness of wiping members, and also by the materials forming the wiping members without changing the thickness of the wiping members. Thus, the range of design is broadened.

In the aforementioned embodiments, one of the wiping members is used to wipe the nozzle surface 24*a* during the normal wiping operation and both of the wiping members are used during the powerful wiping operation. However, it is essential only that the wiping force against the nozzle surface 24*a* during the powerful wiping operation is stronger than that during the normal wiping operation. For example, two wiping members are provided independently in the wiping mechanism so that during the normal wiping operation one of the wiping members that applies a force weaker than that during the powerful wiping operation is used to wipe the nozzle surface 24*a*, and that during the powerful wiping operation the other wiping member that can apply a force stronger than that during the normal wiping operation is used. Alternatively, a number of other wiping members for the powerful wiping operation, which are larger in number than that for normal wiping operation, may be used.

In the embodiments, while the wiper 51, 81, 91 is located at the position where the wiper 51, 81, 91 can wipe the nozzle surface 24*a*, the recording head unit 25 is moved to allow the nozzle surface 24*a* to be wiped by the wiper 51, 81, 91. However, the wiper 51, 81, 91 itself may be driven to wipe the nozzle surface 24*a* without moving the recording head unit 25.

Though the wiping mechanism and cover plate in the embodiments are used for the ink jet print head 24 that ejects a plurality of colors of ink, they may be used for an ink jet head that ejects a single color of ink.

Though the recording head unit 25 in the embodiments is disposed so that the nozzle surface 24*a* is oriented downward, the nozzle surface 24*a* may be inclinatorily and downwardly oriented or horizontally oriented.

In the embodiments, the ink ejection recovery processing is performed using the only the wiping mechanism 50. However, the purge unit 29 may be used to implement the processing in addition to the wiping mechanism 50. In this case, during the normal ink ejection recovery processing, the suction pump 38 is controlled so that its suction force is weaker than that used during the powerful ink ejection recovery processing or the amount of sucking is less than that used during the powerful ink ejection recovery processing. By using the suction pump 38 as described above, defective ink, such as ink including air bubbles, is sucked from the nozzles via the suction cap 41. Then, the nozzle surface 24*a* is wiped using the first wiping member. During the powerful ink ejection recovery processing, the suction pump 38 is controlled so that its suction force is stronger than that used during the normal ink ejection recovery processing or the amount of sucking is more than that used during the normal ink ejection recovery processing. By using such the suction pump 38, the defective ink is sucked from the nozzles via the suction cap 41. After that, the nozzle surface 24*a* is wiped using the first and second wiping members.

While the invention has been described in detail with reference to a specific embodiments thereof, it would be apparent to those skilled in the art that various changes and modifications may be made therein without departing from the spirit of the invention.

What is claimed is:

1. An ink jet recording apparatus comprising:

a recording head with at least one nozzle on a nozzle surface is capable of performing printing on a recording medium by ejecting ink from the nozzle;

a wiping mechanism having a first wiping member and a second wiping member both of which can contact the nozzle surface, wherein at least one of the first and second wiping members can wipe and clean the nozzle surface of the recording head and the first wiping member protrudes from a tip of the second wiping member;

a drive device that relatively moves the wiping mechanism and the recording head with respect to each other to allow the wiping mechanism to wipe the nozzle surface; and a controller that selectively performs either a normal wiping operation for wiping the nozzle surface using the first wiping member with a first wiping force against the nozzle surface of the recording head, or a powerful wiping operation for wiping the nozzle surface using at least the second wiping member with a second wiping force stronger than the first wiping force, in accordance with operational status of the ink jet recording apparatus.

2. The ink jet recording apparatus according to claim 1, wherein the first and second wiping members are disposed adjacent to each other in a wiping direction relative to the recording head.

3. The ink jet recording apparatus according to claim 2, wherein the first and second wiping members are integral to form a monolithic structure.

4. The ink jet recording apparatus according to claim 3, wherein the first and second wiping members are made of a same material and the second wiping member is thicker than the first wiping member.

5. The ink jet recording apparatus according to claim 3, the first and second wiping members are made of different materials and the second wiping member is made of a material that is harder than that for the first wiping member.

6. The ink jet recording apparatus according to claim 3, wherein the first and second wiping members have a clearance having a predetermined length provided therebetween in a wiping direction.

7. The ink jet recording apparatus according to claim 1, wherein the wiping mechanism includes a moving device that moves the first and second wiping members in approaching and receding directions with respect to the nozzle surface, wherein the first wiping member is longer than the second wiping member, toward the nozzle surface, and the controller controls the moving device so that only the first wiping member wipes the nozzle surface during the normal wiping operation and both the first and second wiping members wipe the nozzle surface during the powerful wiping operation.

8. The ink jet recording apparatus according to claim 7, wherein the controller determines the operational status in which the normal wiping operation or the powerful wiping operation is to be performed, in accordance with a time elapsed from a preceding ink ejection, and controls the moving device, to allow the only the first wiping member to wipe the nozzle surface during the normal wiping operation and to allow both the first and second wiping members to wipe the nozzle surface during the powerful wiping operation.

9. The ink jet recording apparatus according to claim 8, wherein the normal wiping operation is performed periodically or when the time elapsed is within a predetermined length of time since ink was ejected, and the powerful wiping operation is performed when the time elapsed is over the predetermined length of time since the ink was ejected.

10. The ink jet recording apparatus according to claim 1, wherein the controller controls the drive device so that only the first wiping member wipes the nozzle surface during the normal wiping operation and both the first and second wiping members wipe the nozzle surface during the powerful wiping operation.

11. The ink jet recording apparatus according to claim 1, wherein the recording head includes a cover plate that is made of a rolled metal plate, attached to the nozzle surface and wiped by the first and second wiping members, the cover plate being attached to the nozzle surface so that a rolled direction when the metal is formed into a plate is substantially parallel with a direction of the wiping of the nozzle surface by wiping mechanism.

12. The ink jet recording apparatus according to claim 11, further comprising a contact angle of the nozzle surface with respect to ink that is larger than a contact angle of the cover plate with respect to the ink.

13. The ink jet recording apparatus according to claim 12, wherein the contact angle of the nozzle surface with respect to the ink is 40 degrees larger than the contact of the cover plate with respect to the ink.

14. The ink jet recording apparatus according to claim 11, wherein the recording head includes a protruding bottom plate of the nozzle surface which carries the nozzle, and the cover plate has a through-hole so as to cover the nozzle surface without covering a nozzle plate and side surfaces of the recording head to be wiped by the wining mechanism.

15. The ink jet recording apparatus according to claim 1, wherein the recording head is capable of performing printing on the recording medium by ejecting pigmented ink.

16. An ink jet recording apparatus, comprising:

a recording head with at least one nozzle on a nozzle surface for performing printing on recording medium by ejecting ink from the nozzle;

a wiping mechanism having a first wiping member and a second wiping member both of which can contact the nozzle surface; wherein at least one of the first and second wiping members can wipe and clean the nozzle surface of the recording head;

a drive device that relatively moves the wiping mechanism and the recording head with respect to each other to allow the wiping mechanism to wipe the nozzle surface; and a controller that selectively performs either a normal wiping operation for wiping the nozzle surface using the first wiping member or a powerful wiping operation for wiping the nozzle surface using both the first and second wiping members, in accordance with operational status of the ink jet recording apparatus.

17. A method for wiping a nozzle surface of a recording head provided in an ink jet recording apparatus, the ink jet recording apparatus including a wiping mechanism having a first and second wiping members for wiping and cleaning the nozzle surface and a drive device for relatively moving the wiping mechanism and the recording head with respect to each other to allow the wiping mechanism to wipe the nozzle surface, comprising the steps of:

analyzing an operational status of the ink jet recording apparatus;

determining predetermined time periods from a preceding ink ejection based on analytical results;

determining between a normal wiping operation, in which the nozzle surface is wiped using the first wiping member with a first wiping force against the nozzle surface, and a powerful wiping operation, in which the nozzle surface is wiped using at least the second wiping member with a second wiping force stronger than the first wiping force, in accordance with the analytical results and the predetermined time periods; and controlling the wiping mechanism for performing the determined wiping operation.

18. The method according to claim 17, further comprising the step of controlling the wiping mechanism so that only the first wiping member wipes the nozzle surface during the normal wiping operation and both the first and second wiping members wipe the nozzle surface during the powerful wiping operation.

19. The method according to claim 17, wherein the step of analyzing the operational status of the ink jet recording apparatus is analyzed based on time elapsed since a preceding ink ejection is performed, and the normal wiping operation is performed periodically or when the time elapsed is within a predetermined length of time since ink was ejected, and the powerful wiping operation is performed when the time elapsed is over the predetermined length of time since the ink was ejected.

* * * * *